US007985101B2

(12) United States Patent
Fitzpatrick

(10) Patent No.: US 7,985,101 B2
(45) Date of Patent: Jul. 26, 2011

(54) RJ-45 STYLE COMMUNICATIONS JACKS THAT ARE CONFIGURED TO RECEIVE BOTH RJ-45 AND RJ-11 STYLE COMMUNICATIONS PLUGS

(75) Inventor: Brian Fitzpatrick, McKinney, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 299 days.

(21) Appl. No.: 12/359,750

(22) Filed: Jan. 26, 2009

(65) Prior Publication Data

US 2010/0190366 A1 Jul. 29, 2010

(51) Int. Cl.
*H01R 24/00* (2006.01)

(52) U.S. Cl. ..... 439/676

(58) Field of Classification Search ..... 439/677, 439/217–224, 676, 73, 941
See application file for complete search history.

(56) References Cited

U.S. PATENT DOCUMENTS

| | | | | |
|---|---|---|---|---|
| 3,614,714 | A | 10/1971 | Silverstein | |
| 4,376,565 | A | 3/1983 | Bird et al. | |
| 4,781,626 | A | 11/1988 | Lazarchik | |
| 5,244,402 | A | 9/1993 | Pasterchick, Jr. et al. | |
| 5,370,556 | A | 12/1994 | Olsson | |
| 5,387,135 | A | 2/1995 | Shen et al. | |
| 5,772,466 | A | 6/1998 | Morin et al. | |
| 6,059,583 | A | 5/2000 | Croft et al. | |
| 6,186,835 | B1 | 2/2001 | Cheshire | |
| 6,244,907 | B1 | 6/2001 | Arnett | |
| 6,257,935 | B1 | 7/2001 | Zhang et al. | |
| 6,296,528 | B1 * | 10/2001 | Roberts et al. | 439/676 |
| 6,312,293 | B1 | 11/2001 | Wang | |
| 6,319,070 | B1 | 11/2001 | Tan | |
| 6,375,516 | B1 | 4/2002 | Trinh | |
| 6,416,364 | B1 | 7/2002 | Shi et al. | |
| 6,458,001 | B1 | 10/2002 | Chen et al. | |
| 6,641,441 | B2 | 11/2003 | Itano et al. | |
| 6,786,776 | B2 | 9/2004 | Itano et al. | |
| 6,890,197 | B2 * | 5/2005 | Liebenow | 439/188 |
| 7,125,288 | B2 | 10/2006 | Schilling | |
| 7,311,562 | B2 | 12/2007 | Leong et al. | |
| 7,427,218 | B1 | 9/2008 | Hashim et al. | |
| 2005/0153580 | A1 | 7/2005 | Schilling | |

FOREIGN PATENT DOCUMENTS

WO WO 03/007433 A1 1/2003

OTHER PUBLICATIONS

Picture of jack housing for CommScope's MGS-400 communications jack (Admitted Prior Art). International Search Report and Written Opinion of the International Searching Authority for PCT/US2009/069634, dated Mar. 9, 2010.
Technical Bulletin, "Retention Force Technology," Leviton, 2007, Circle Card Reader #131, no date.
U.S. Appl. No. 12/016,338, Goodrich et al., Jan. 18, 2008.

* cited by examiner

*Primary Examiner* — Edwin A. Leon
(74) *Attorney, Agent, or Firm* — Myers Bigel Sibley & Sajovec

(57) ABSTRACT

RJ-45 style communications jacks include a housing having a plug receiving cavity that is defined, at least in part, by opposed upper and lower surfaces. A first guide protrudes from the upper surface into the plug receiving cavity. A first channel is formed in the lower surface. The width of this first channel is greater than the width of a housing of an RJ-11 style communications plug but less than a width of a housing of an RJ-45 style communications plug. Moreover, the length of the first channel is sufficient to allow the RJ-11 style communications plug to be fully inserted within the plug receiving cavity.

32 Claims, 10 Drawing Sheets

RJ-45 STYLE COMMUNICATIONS JACKS THAT ARE CONFIGURED TO RECEIVE BOTH RJ-45 AND RJ-11 STYLE COMMUNICATIONS PLUGS

FIELD OF THE INVENTION

The present invention relates generally to communications connectors and, more particularly, to RJ-45 style communications jacks.

BACKGROUND

Many hardwired communications systems use plug-jack connectors to connect a communications cable to another communications cable or to a piece of equipment such as a computer, printer, server, switch or patch panel. By way of example, high speed communications systems routinely use such plug-jack connectors to connect computers, printers and other devices to local area networks and/or to external networks such as the Internet. FIG. 1 depicts a simplified example of such a hardwired high speed communications system that illustrates how plug-jack connectors may be used to interconnect a computer 1 to, for example, a network server 10.

As shown in FIG. 1, the computer 1 is connected by a cable 2 to a communications jack 5 that is mounted in a wall plate 9. The cable 2 is a patch cord that includes a communications plug 3, 4 at each end thereof. Typically, the cable 2 includes a plurality of wire conductors (e.g., eight), which are arranged in pairs so that each pair of conductors may carry a separate differential signal. Communications plug 3 inserts into a communications jack (not pictured in FIG. 1) provided in the back of the computer 1. Communications plug 4 inserts into an opening or "plug aperture" 6 in the front side of the communications jack 5 so that the contacts of the communications plug 4 mate with respective contacts of the communications jack 5 (if the cable 2 includes eight conductors, the communications plugs 3, 4 and the communications jack 5 will typically each have eight contacts). The communications jack 5 includes a wire connection assembly 7 at the back end thereof that receives a plurality of conductors (e.g., eight) from a second cable 8 that are individually pressed into slots in the wire connection assembly 7 to establish mechanical and electrical connections between each conductor of the second cable 8 and a respective one of a plurality of conductive paths through the communications jack 5. The other end of the second cable 8 is connected to a network server 10 which may be located, for example, in a telecommunications closet of a commercial office building. Thus, the patch cord 2, the cable 8 and the communications jack 5 provide a plurality of electrical paths (e.g., four differential signal paths) between the computer 1 and the network server 10. Each of these electrical paths may be used to communicate electrical information signals between the computer 1 and the network server 10. It will be appreciated that typically one or more patch panels or switches, along with additional communications cabling, would be included in the electrical path between the second communications cable 8 and the network server 10. However, for ease of description, these additional elements have been omitted from FIG. 1 and the second communications cable 8 is instead shown as being directly connected to the server 10.

In order to provide standardization between the high speed communications equipment marketed and sold by different vendors, industry standards documents have been promulgated that specify various mechanical and electrical properties for communications jacks and plugs. One example of such a standard is the TIA/EIA-568-B.2-1 standard that was approved on Jun. 20, 2002 by the Telecommunications Industry Association. These industry standard documents typically incorporate, by reference, interface and wiring standards that specify, among other things, the dimensions and configurations of various types of standardized communications plugs and jacks so that industry standards-compliant plugs and jacks sold by different vendors will work with each other.

By way of example, the above-referenced TIA/EIA-568-B.2-1 standard requires compliance with interface specifications set forth in the FCC Part 68.500 document, which defines, among other things, the dimensions and configurations for various plug-jack interfaces, including plugs and jacks that conform to the Registered Jack 45 ("RJ-45") wiring standard and plugs and jacks that conform to the Registered Jack 11 ("RJ-11") wiring standard. The RJ-45 wiring standard describes wiring specifications for eight wire connector assemblies (including plugs and jacks) that are commonly used, for example, in Ethernet networks to connect computers and other hardware to local area networks (LAN) and/or the Internet, as is discussed above with respect to FIG. 1. The RJ-11 wiring standard, on the other hand, describes wiring specifications for four and six wire connector assemblies that are used in the United States primarily to connect telephone equipment. Herein, a plug or jack that substantially complies with the RJ-11 wiring standard is referred to as an "RJ-11" or "RJ-11 style" communications plug or jack, and a plug or jack that substantially complies with the RJ-45 wiring standard is referred to as an "RJ-45" or "RJ-45 style" communications plug or jack.

FIG. 2A is a simplified perspective view of an RJ-45 style communications jack 20, and FIG. 2B is a simplified plan view of an RJ-45 style communications plug 30. FIG. 4 is a perspective view of the RJ-45 style communications plug 30. As shown in FIG. 2A, RJ-45 jack 20 includes eight resilient jackwire contacts 21-28, which are mounted so that they extend into a plug receiving cavity 29. As shown in FIGS. 2B and 4, the RJ-45 communications plug 30 includes eight plug contacts 31-38, which are often referred to as "blades." The plug contacts 31-38 are received within contact slots 31'-38' that are provided in the top surface of the housing 39 of RJ-45 communications plug 30 (each contact slot 31'-38' also extends into the front surface of RJ-45 communications plug 30). The contact slots 31'-38' on RJ-45 communications plug 30 are positioned so that when the plug 30 is inserted into RJ-45 communications jack 20, the contact slots 31'-38' are aligned with plug contact regions of respective ones of jackwire contacts 21-28. Thus, when the RJ-45 communications plug 30 is inserted into the plug receiving cavity 29 of RJ-45 communications jack 20, the plug blades 31-38 make mechanical and electrical connection with respective ones of the jackwire contacts 21-28. The plug-jack interface is designed so that, as the plug 30 is inserted into plug receiving cavity 29, the blades 31-38 of the RJ-45 communications plug 30 engage the plug contact regions of their respective jackwire contacts 21-28 and deflect the jackwire contacts 21-28 back and/or upward a short distance. The resiliency of the jackwire contacts 21-28 creates a "contact force" that holds the jackwire contacts 21-28 in firm engagement with their respective plug blades 31-38. When the RJ-45 communications plug 30 is removed, the jackwire contacts 21-28 move downwardly and/or forwardly back into their normal resting position.

FIG. 3A is a simplified perspective view of a six contact RJ-11 communications jack 40, and FIG. 3B is a simplified plan view of a six contact RJ-11 communications plug 50. As shown in FIG. 3A, the RJ-11 communications jack 40 includes six jackwire contacts 42-47, which are mounted so that they extend into a plug receiving cavity 49. As shown in FIG. 3B, the RJ-11 communications plug 50 includes six plug contacts 52-57. The plug blades 52-57 are received within contact slots 52'-57' on the top surface of the housing 59 of RJ-11 communications plug 50. The contact slots 52'-57' on RJ-11 communications plug 50 are positioned so that when the plug 50 is inserted into RJ-11 communications jack 40, the contact slots 52'-57' are aligned with plug contact regions of respective ones of the jackwire contacts 42-47. The RJ-11 communications plug 50 and jack 40 work together in the same manner, described above, that the RJ-45 communications plug 30 and jack 20 work together. An RJ-11 communications plug with four contacts does not contain contacts 52 and 57, but does include the contact slots 52' and 57'. As the differences between four contact and six contact RJ-11 plugs are immaterial to this description, the remainder of this specification will focus on six contact RJ-11 communications plugs.

As is evident from FIGS. 2-4, RJ-45 connector assemblies (i.e., plugs and jacks) look very similar to RJ-11 connector assemblies, except that RJ-45 communications plugs and jacks are slightly wider than RJ-11 communications plugs and jacks and include at least two more contacts. Moreover, telephone and facsimile lines that are wired using RJ-11 style communications plugs and jacks are often located in the telecommunications closet of a building in close proximity to Ethernet equipment that is wired using RJ-45 plugs and jacks. Due to the visual similarities between the RJ-11 and RJ-45 connector assemblies, and their close proximity in many telecommunications closets, all too often the slightly narrower RJ-11 communications plugs are inserted into RJ-45 communications jacks.

Unfortunately, when an RJ-11 communications plug is inserted into an RJ-45 communications jack, the RJ-45 communications jack can be damaged. This can best be seen with reference to FIG. 5, which is a cross-sectional diagram taken along line 5-5 of FIG. 4. As shown in FIG. 5, the vertical height of the housing 39 of plug 30 is about 0.260". However, the plug blades 31-38 that are mounted in the contact slots 31'-38' do not extend all the way to the top of housing 39. Accordingly, the effective height of the housing 39 along respective ones of the contact slots 31'-38' is somewhat less (approximately 0.023" less) than the height of the housing 39. The same is true with respect to the RJ-1 plug 50 of FIG. 3B, namely the height of the housing 59 of plug 50 is approximately 0.260", while the distance from the top edge of each plug blade 52-57 to the bottom of the housing 59 is only about 0.237".

When RJ-11 communications plug 50 is inserted into RJ-45 communications jack 20, the forward and top surfaces of the housing 59 of the plug 50 engage jackwire contacts 21 and 28 of jack 20, as the six blade RJ-11 communications plug 50 does not include contact slots or plug blades in the outside two contact positions (i.e., the major difference between the six contact RJ-11 communications plug 50 and the RJ-45 communications plug 30 is that the RJ-11 communications plug 50 does not include slots 31' and 38' and contacts 31 and 38 that are included on the RJ-45 communications plug 30). As the housing 59 of RJ-11 communications plug 50 (as opposed to contacts of plug 50), which has the full height of 0.260", engages the outside jackwire contacts 21 and 28, the jackwire contacts 21 and 28 of jack 20 are over-deflected by 0.023" when RJ-11 communications plug 50 is accidentally inserted into RJ-45 communications jack 20 (as compared to when an RJ-45 plug is inserted). Unless the jackwire contacts 21 and 28 of jack 20 are specially designed to accommodate this additional amount of deflection, the jackwire contacts 21 and 28 may become permanently set in this over-deflected position if RJ-11 communications plug 50 is inserted into RJ-45 communications jack 20 (i.e., the contacts lose some or all of their ability to spring back into their resting position). If this occurs, when an RJ-45 communications plug 30 is later inserted into the RJ-45 communications jack 20, the "contact force" needed to keep blades 31 and 38 of the RJ-45 communications plug 30 in abutment with the respective jackwire contacts 21 and 28 of the RJ-45 communications jack 20 may not be exerted (or may be insufficient), which may result in poor performance. When insufficient contact force is exerted, the RJ-45 communications jack 20 may also fail to pass certain tests in the industry standards such as, for example, a specified minimum contact resistance that must be maintained between each plug blade and its respective jackwire contact after a minimum number of plug insertions and removals and under various environmental conditions (e.g., temperatures, relative humidity, etc.).

SUMMARY

Pursuant to embodiments of the present invention, communications jacks are provided with features that facilitate, for example, usability of RJ-45 style communications jacks with RJ-45 style communications plugs after RJ-11 style communications plugs have been used in the RJ-45 style communications jacks.

Pursuant to certain embodiments of the present invention, RJ-45 style communications jacks are provided which include a housing having a plug receiving cavity that is defined at least in part by opposed upper and lower surfaces. A first guide protrudes from the upper surface into the plug receiving cavity, and a first channel is provided in the lower surface of the plug receiving cavity. The first channel is wider than a housing of an RJ-11 style communications plug but not as wide as the housing of an RJ-45 style communications plug. The length of the first channel is sufficient to allow the RJ-11 style communications plug to be fully inserted within the plug receiving cavity.

In some embodiments of these jacks, the first guide is configured to contact a top surface of the housing of the RJ-11 style communications plug when the RJ-11 style communications plug is inserted within the plug receiving cavity to direct the RJ-11 style communications plug downwardly into the first channel. These jacks may also include eight jackwire contacts that are mounted to extend into the plug receiving cavity and a first jackwire contact deflection limiter. In such embodiments, a plug contact region of the first jackwire contact, the first guide and the first jackwire contact deflection limiter may be transversely aligned with each other, and the first guide and the first jackwire contact deflection limiter may be on opposite sides of the first jackwire contact. The first jackwire contact deflection limiter may be configured to limit the upward deflection of at least part of the first jackwire contact.

In some embodiments, the first guide may be transversely aligned with a first blade of any RJ-45 style communications plug that is received within the plug receiving cavity. A surface of the first guide that faces a front opening into the plug receiving cavity may be positioned to engage a leading edge of the housing of the standards compliant RJ-11 style communications plug when the RJ-11 style communications plugs is received within the plug receiving cavity, and the first guide may be positioned to be aligned with a contact slot on the RJ-45 style communications plug when the RJ-45 style communications plug is received within the plug receiving cavity. At least a portion of a surface of the first guide that faces a front opening into the plug receiving cavity may be sloped in some embodiments.

In some embodiments, the jacks may include a second guide that protrudes from the upper surface into the plug receiving cavity. The second guide may be spaced apart from the first guide. In such embodiments, the first guide may be positioned to be transversely aligned with a first blade of the RJ-45 style communications plug and the second guide may be positioned to be transversely aligned with a second blade of the RJ-45 style communications plug when the RJ-45 style communications plug is received within the plug receiving cavity, where the first and second blades are the blades that are on the ends of the row of blades provided on the RJ-45 style communications plug. These jacks may also include eight jackwire contacts that are mounted so that their respective plug contact regions extend into the plug receiving cavity and are generally aligned in numerical order in a row, along with first and second jackwire contact deflection limiters. In such embodiments, the plug contact region of the first jackwire contact, the first guide and the first jackwire contact deflection limiter may be transversely aligned with each other, and the plug contact region of the eighth jackwire contact, the second guide and the second jackwire contact deflection limiter may be transversely aligned with each other. Moreover, the first guide and the first jackwire contact deflection limiter may be on opposite sides of the first jackwire contact, and the second guide and the second jackwire contact deflection limiter may be on opposite sides of the eighth jackwire contact.

In some embodiments, the upper surface of the plug receiving cavity may include eight guide slots that receive respective ones of the distal ends of the eight jackwire contacts. The upper surface of the plug receiving cavity may comprise at least first and second housing pieces, where the first guide protrudes from the first housing piece and the first jackwire contact deflection limiter is part of the second housing piece. The jacks may also include a second channel that runs in the middle of the first channel so as to increase the depth of a middle portion of the first channel. This second channel may be sized to receive a latch portion of an RJ-45 style communications plug.

Pursuant to further embodiments of the present invention, RJ-45 style communications jacks are provided which include a jack frame that has a top wall, a bottom wall and opposed first and second side walls that define a plug receiving cavity. These jacks further include eight jackwire contacts that are mounted so that their respective plug contact regions extend into the plug receiving cavity generally aligned in a row in numerical order. The jacks also have a first guide extending from an interior surface of the top wall into the plug receiving cavity and a first jackwire contact deflection limiter extending from the interior surface of the top wall into the plug receiving cavity. The first jackwire contact, the first guide and the first jackwire contact deflection limiter are transversely aligned with each other.

Pursuant to still further embodiments of the present invention, RJ-45 style communications jacks are provided that include a housing having a plug receiving cavity that is defined at least in part by opposed upper and lower surfaces. The upper surface of the plug receiving cavity includes eight contact slots. Eight jackwire contacts are mounted to extend into the plug receiving cavity such that a distal end of each of the eight jackwire contacts extends through a respective one of the eight contact slots. Eight jackwire contact deflection limiters are provided that extend from the upper surface toward the plug receiving cavity, where each of the eight jackwire contact deflection limiters is transversely aligned with a respective one of the eight jackwire contacts. Finally, the jacks further include a first channel in the lower surface of the plug receiving cavity. A width of the first channel is greater than a width of a housing of the RJ-11 style communications plug but less than a width of a housing of the RJ-45 style communications plug, and a length of the first channel is sufficient to allow the RJ-11 style communications plug to be fully inserted within the plug receiving cavity.

DETAILED DESCRIPTION

Figure 1:
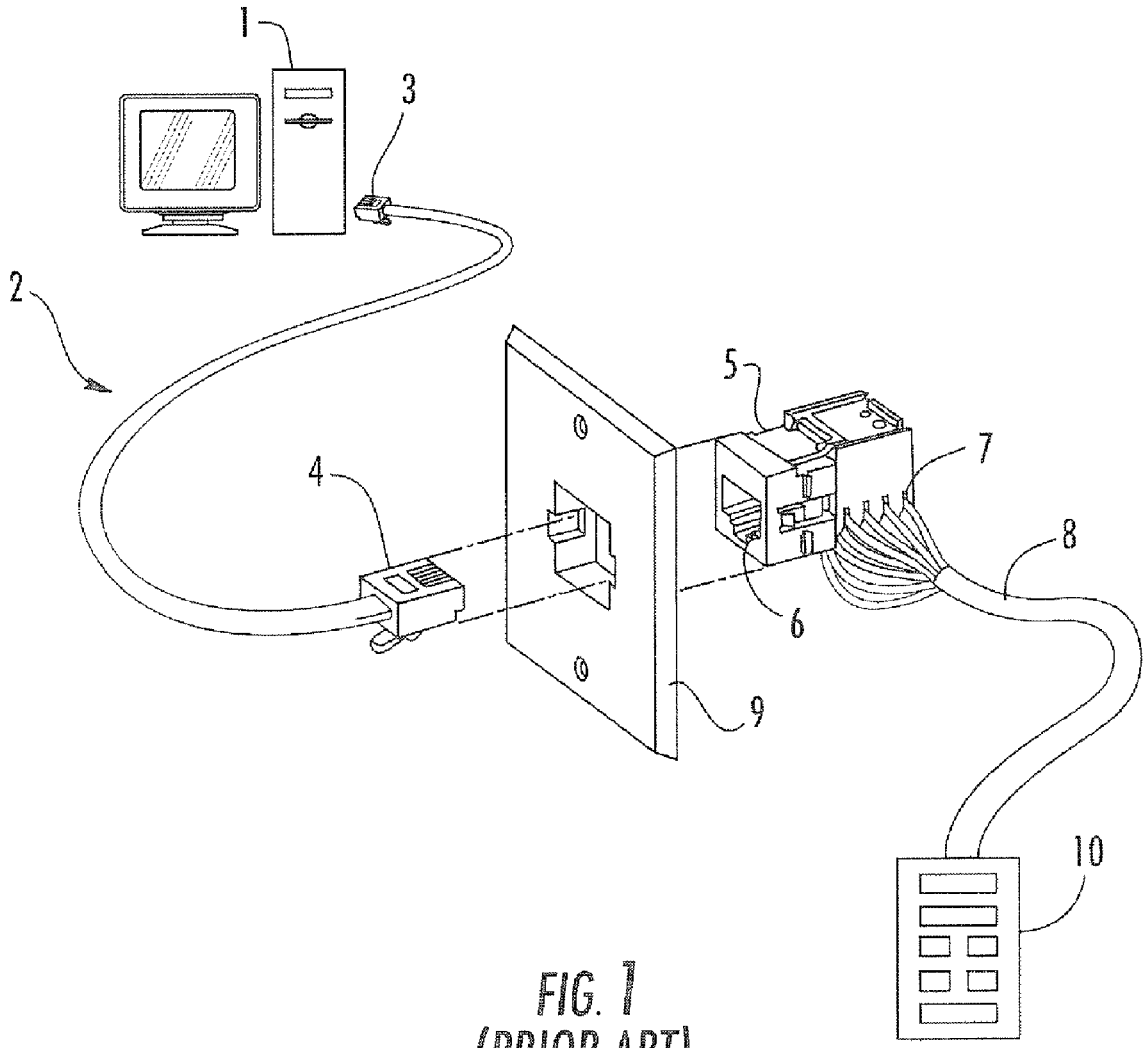
FIG. 1 (PRIOR ART)
FIG. 1 is a simplified schematic diagram illustrating the use of conventional communications plugs and jacks to interconnect a computer with network equipment.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "top," "bottom," "side," "upper," "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The present invention is directed to RJ-45 style communications jacks. As used herein, the terms "forward" and "front" and derivatives thereof refer to the direction defined by a vector extending from the center of the jack toward the plug aperture of the jack. Conversely, the term "rearward" and derivatives thereof refer to the direction directly opposite the forward direction; the rearward direction is defined by a vector that extends away from the plug aperture toward the remainder of the jack. Together, the forward and rearward directions define the "longitudinal" dimension of the jack. The term "lateral" and derivatives thereof refer to the direction generally parallel with the line defined by the side of the plug aperture that includes a cutout for the latch of a mating plug and extending away from a plane that longitudinally bisects the center of the jack. The term "medial" and derivatives thereof refer to the direction that is the converse of the lateral direction. Together, the lateral and inward directions define the "transverse" dimension of the jack. A line normal to the longitudinal and transverse dimensions defines the "vertical" dimension of the jack. Herein, the term "length" is used to refer to a distance in the longitudinal dimension, the term "width" is used to refer to a distance in the transverse dimension, and the term "depth" is used to refer to a distance in the vertical dimension.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 6:
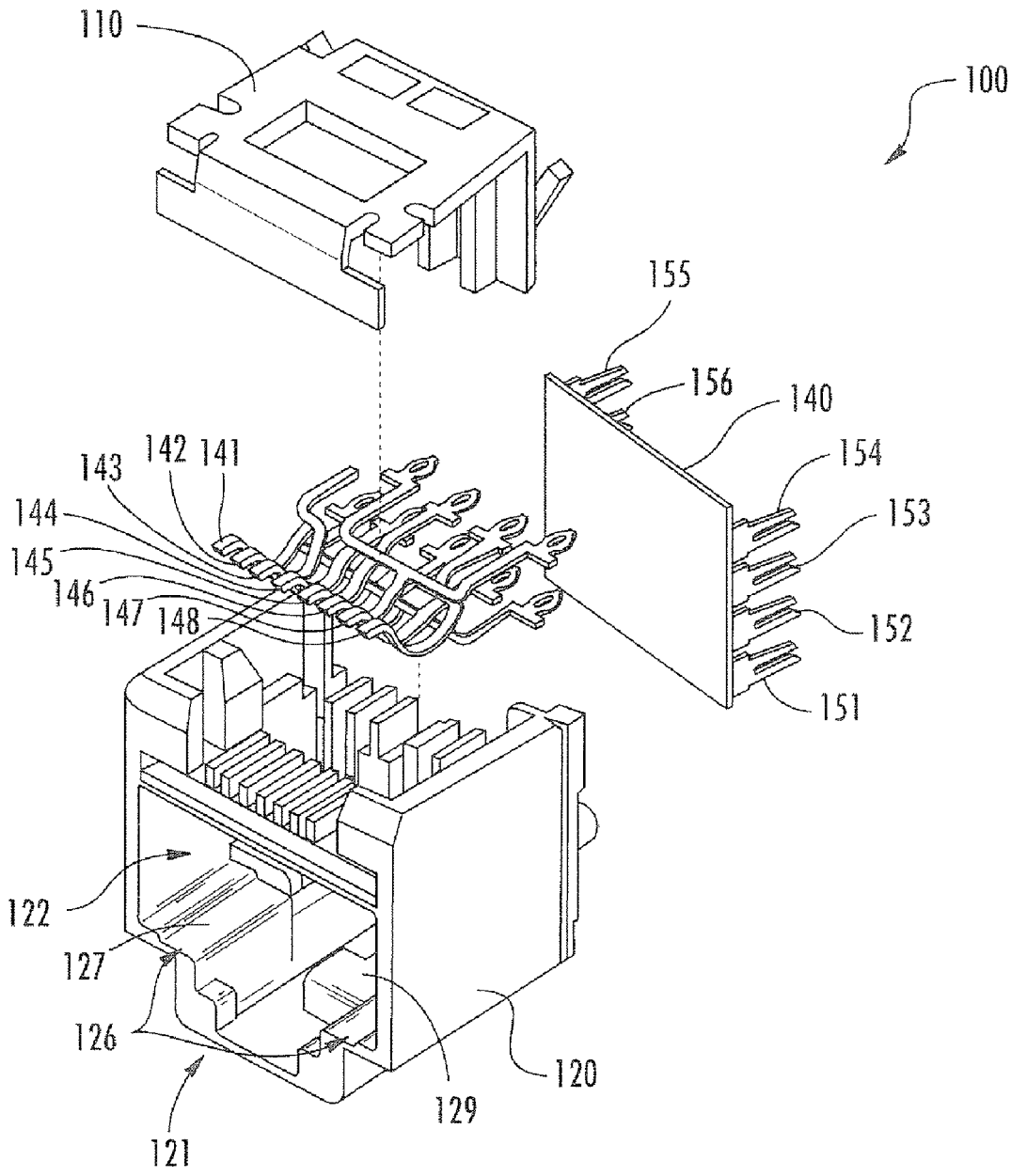
FIG. 6 is an exploded perspective view of an RJ-45 communications jack according to embodiments of the present invention.

FIG. 6 is an exploded perspective view of an RJ-45 communications jack 100 according to certain embodiments of the present invention. As shown in FIG. 6, the jack 100 includes a housing 110, 120, a plurality of jackwire contacts 141-148, a wiring board 140 and a plurality of wire connection terminals 151-158 (only wire connection terminals 151-156 are visible in FIG. 6).

As shown in FIG. 6, the housing is a multi-piece housing that comprises a top cover 110 and a jack frame 120. The housing will also typically include a terminal cover (not shown in FIG. 6) that covers and protects the wire connection terminals 151-158 provided at the back end of communications jack 100. The jack frame 120, top cover 110 and the terminal cover may be made of a suitable insulative plastic material that meets all applicable standards with respect to, for example, electrical breakdown resistance and flammability. Typical materials include, but are not limited to, polycarbonate, ABS, and blends thereof. While communications jack 100 includes a specific multi-piece housing, it will be appreciated that the housing may be any conventional or unconventional housing structure, and may comprise a one-piece housing in some embodiments. The jack frame 120 includes a front opening or "plug aperture" 121 that provides access to a plug receiving cavity 122. While the term "plug aperture" is sometimes used in the art to refer to the front opening of a jack frame and/or the cavity within the jack frame that receives the mating plug, herein, for clarity, the term "plug aperture" is used to refer to the opening in the front face of the jack frame 120 and the term "plug receiving cavity" is used to refer to the cavity behind the plug aperture 121 that receives a mating plug. The top cover 110 and the jack frame 120 will be discussed in greater detail below with respect to FIGS. 7 and 8 which more clearly illustrate features of top cover 110 and the jack frame 120 which may prevent the insertion of RJ-11 style communications plugs into communications jack 100 from damaging the jackwire contacts 141 and 148 as may occur if mechanisms are not provided to protect against such damage.

As shown in FIG. 6, top cover 110 protects the eight jackwire contacts 141-148. The jackwire contacts 141-148 are mounted beneath the top cover 110 so as to extend into the plug receiving cavity 122. The wiring board 140 is mounted vertically at the back of the jack frame 120, and each of the eight jackwire contacts 141-148 are mounted in the wiring board 140 in a conventional fashion such as, for example, by press-fitting the compliant pin terminations of each jackwire contact into a respective metal-plated hole (not shown in FIG. 6) of the wiring board 140. A plurality of wire connection terminals 151-158 (which are implemented as insulation displacement contacts or "IDCs" in the jack of FIG. 6) are mounted on the surface of the wiring board 140 that is opposite the surface of the wiring board in which the eight jackwire contacts 141-148 are mounted. Each of the IDCs 151-158 is connected to a respective one of the jackwire contacts 141-148 via conductive traces/paths on the wiring board 140.

The wiring board 140 may comprise any type of substrate that includes the above-referenced conductive paths that connect each jackwire contact 141-148 to a respective one of the wire connection terminals 151-158. The wiring board 140 may also include electrical circuit components or devices arranged on or within the board to compensate for crosstalk that may otherwise be present in the jack 100 and/or in an associated plug that mates with the jack 100. Such devices include, but are not limited to, closely spaced wire traces printed on or within layers of the wiring board 140 (including, for example, side-by-side conductive trace segments and overlying conductive trace segments), plate capacitors implemented on two or more layers or surfaces of the board, interdigitated finger capacitors such as the interdigitated finger capacitors disclosed, for example, in U.S. Pat. No. 5,997,358, and discrete electrical components such as inductors, capacitors or resistors that are mounted on or within the wiring board 140.

As is also shown in FIG. 6, the jackwire contacts 141-148 are cantilevered from the rear of communications jack 100 toward the front of communications jack 100 so as to extend into the plug receiving cavity 122. Herein, the term "contact", when used as a noun, refers to an electrically conductive element that is designed to establish physical and electrical contact with an electrically conductive element on another device. The jackwire contacts 141-148 depicted in FIG. 6 are one such type of contact that is known in the art. The contacts

141-148 are referred to as "jackwire" contacts because the contacts are configured to resiliently deflect from a resting position when contacted by a mating plug, and then recover or "spring back" to the resting position when the mating plug is removed. Each contact 141-148 includes a plug contact region that is configured to make mechanical and/or electrical contact with a blade of a communications plug that is inserted into the communications jack 100. Each jackwire contact 141-148 may be formed, for example, of a copper alloy such as spring-tempered phosphor bronze, beryllium copper, or the like. A typical cross-section of each jackwire contact 141-148 is 0.017 inch wide by 0.010 inch thick, although other sized and/or shaped (e.g., round) contacts may be used.

As shown in FIG. 6, some of the contacts include a "crossover" in that one contact crosses over or under another contact when the jackwire contacts are viewed from above when the jack is oriented as shown in FIG. 6. Additionally, two of the contacts also include a support beam that is mounted into the wiring board 140. While the contacts 141-148 of the embodiment depicted in FIG. 6 show one possible jackwire contact configuration, it will be appreciated that essentially any contact configuration will work with embodiments of the present invention. Accordingly, the jackwire contacts 141-148 may have the same or different profiles, may or may not be generally aligned in a side-by-side relationship (except to the extent that general alignment is required in the plug contact region of the contacts to conform to industry standards), may or may not include crossovers, may have different numbers of crossovers, may have staggers where they enter the wiring board, may be cantilevered from the front, etc.

Figure 2A:
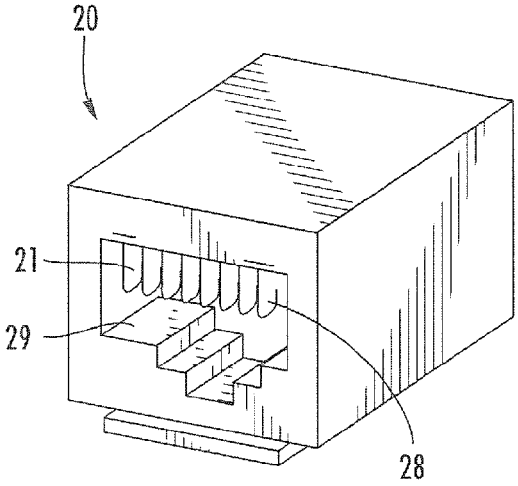
FIG. 2A (PRIOR ART)
FIG. 2A is a simplified perspective view of a conventional RJ-45 communications jack.
Figure 2B:
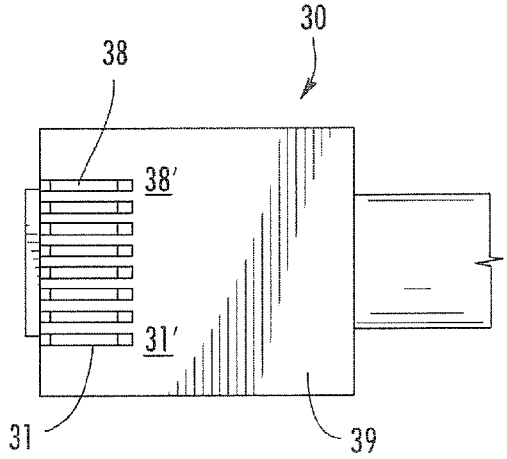
FIG. 2B (PRIOR ART)
FIG. 2B is a simplified plan view of a conventional RJ-45 communications plug.
Figure 4:
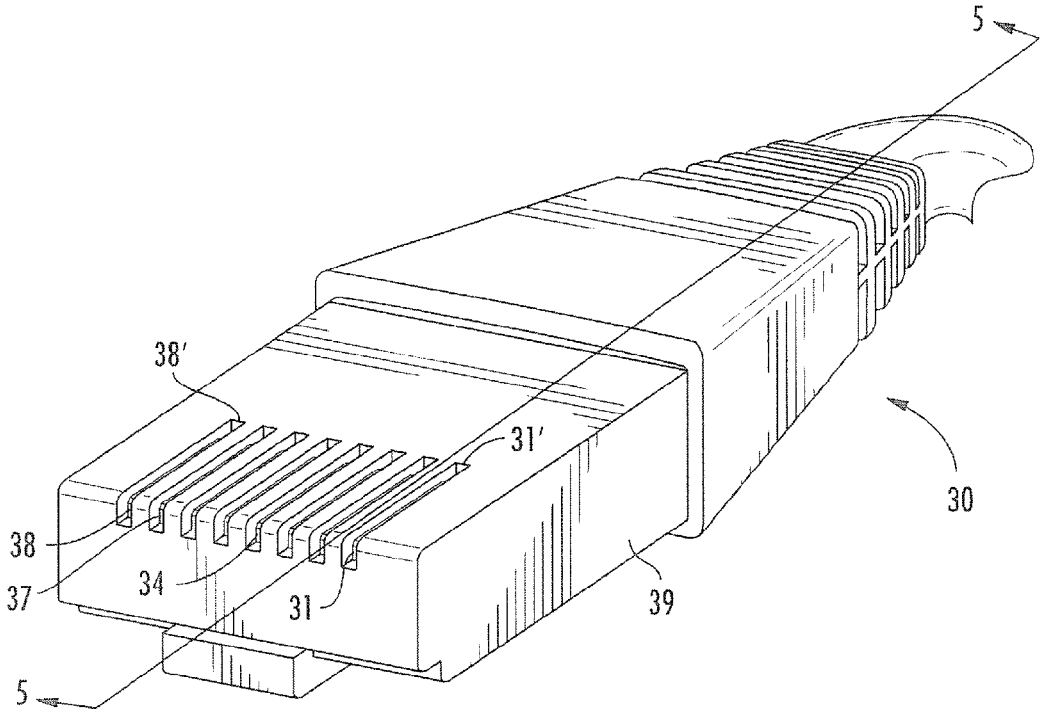
FIG. 4 (PRIOR ART)
FIG. 4 is a perspective view of the conventional RJ-45 communications plug of FIG. 2B.
Figure 5:
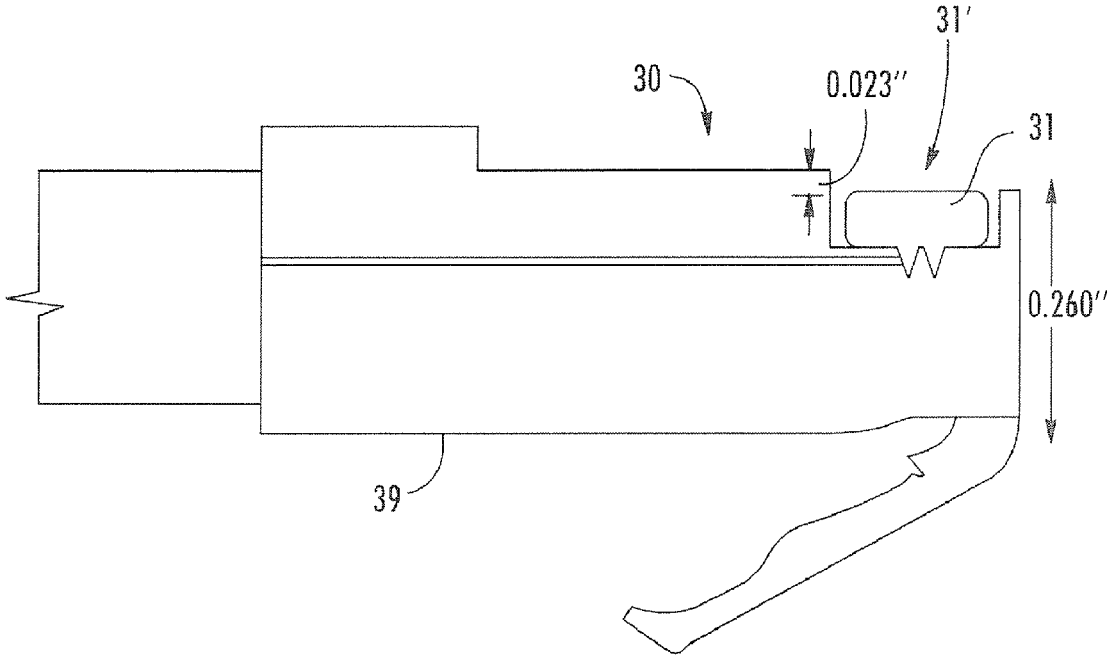
FIG. 5 (PRIOR ART)
FIG. 5 is a cross-sectional view of the RJ-45 communications plug of FIG. 4 taken along the line 5-5 thereof.

As noted above, the plug receiving cavity 122 of communications jack 100 is configured to receive, through plug aperture 121, the leading portion of the housing of RJ-45 style communications plug. As discussed above with respect to FIGS. 2B and 4, an RJ-45 communications plug includes eight plug contacts or "blades" which are received within contact slots on the leading and/or top surface of the plug housing. The contact slots on the plug are positioned so that when the plug is inserted into communications jack 100, the plug contact slots are aligned with plug contact regions of respective ones of jackwire contacts 141-148. Thus, when the RJ-45 communications plug is inserted into the plug receiving cavity 122 of communications jack 100, the plug blades establish mechanical and electrical connection with respective ones of the jackwire contacts 141-148.

Figure 3A:
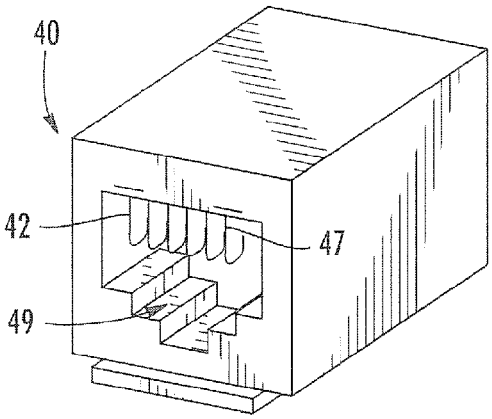
FIG. 3A (PRIOR ART)
FIG. 3A is a simplified perspective view of a conventional RJ-11 communications jack.
Figure 3B:
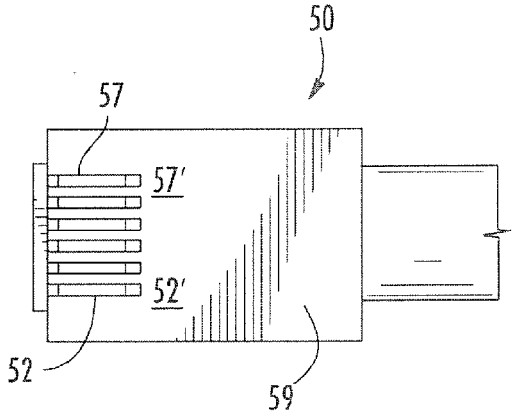
FIG. 3B (PRIOR ART)
FIG. 3B is a simplified plan view of a conventional RJ-11 communications plug.

As discussed above, when an RJ-11 communications plug (e.g., plug 50 of FIG. 3B) is inserted into a standard RJ-45 communications jack, the housing of the RJ-11 plug engages the outside contacts (i.e., contacts 141 and 148) of the jack, while the blades of the RJ-11 plug engage respective ones of the interior jackwire contacts (i.e., contacts 142-147). As the plug housing extends approximately 0.023" higher in the vertical direction than do the plug contacts, the outside jackwire contacts 141, 148 may be deflected beyond their normal deflected positions (i.e., beyond their deflected positions when an RJ-45 communications plug is inserted into the RJ-45 communications jack) when the RJ-11 plug is fully inserted within the communications jack. This can cause the outside jackwire contacts of the RJ-45 communications jack to be permanently deformed as a result of this additional deflection after the RJ-11 plug has been removed.

In order to prevent such damage, the RJ-45 communications jack 100 includes structures that redirect any RJ-11 communications plug that is inserted into the plug receiving cavity 122 of jack 100 and may further include additional structures that protect one or more of the jackwire contacts 141-148 from damage. As shown in FIG. 6 and as is discussed in detail with respect to FIGS. 7-11 below, in some embodiments, these structures may comprise one or more guides, an RJ-11 communications plug channel, and one or more jackwire contact deflection limiters.

Figure 7:
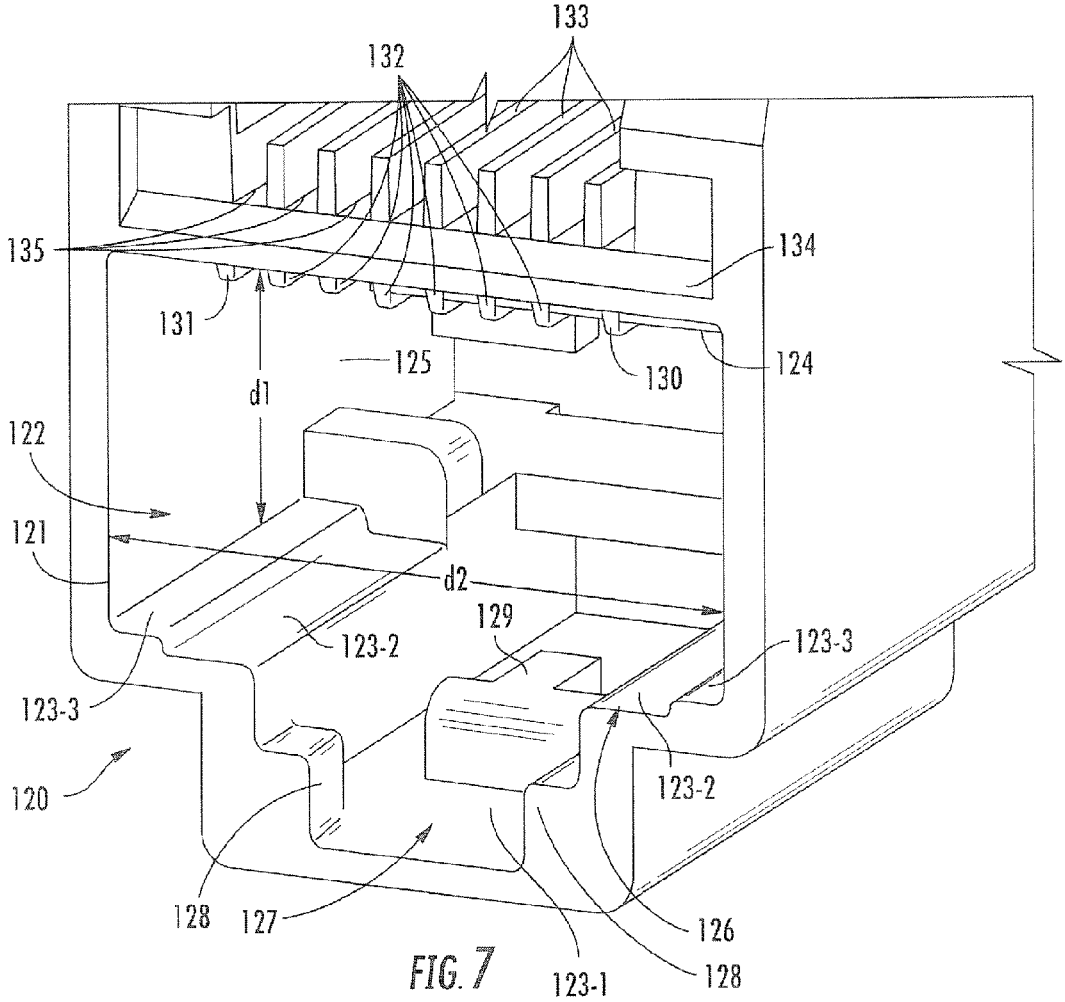
FIG. 7 is an enlarged partial perspective view of the jack frame of the communications jack of FIG. 6.
Figure 8:
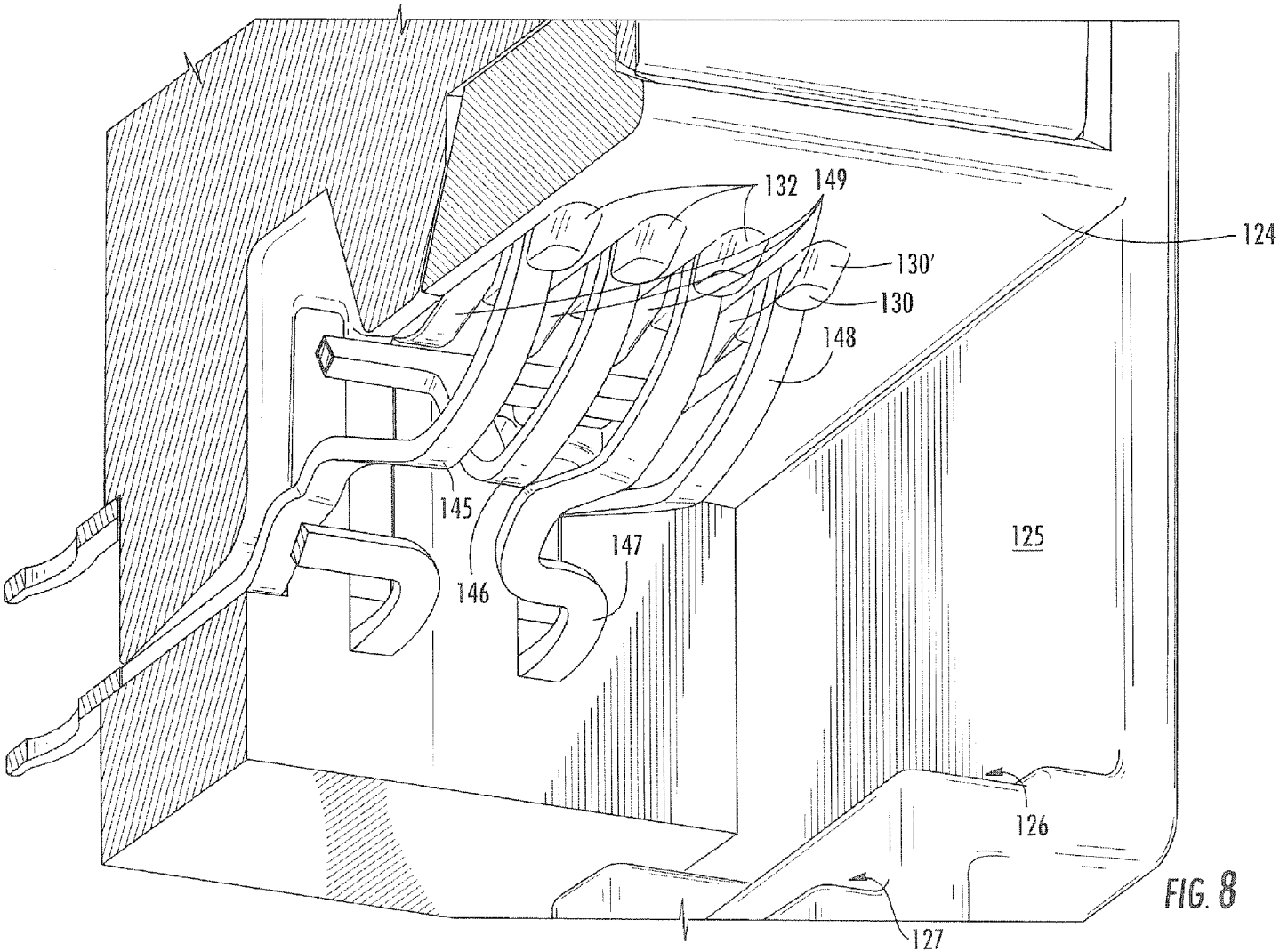
FIG. 8 is a partial cross-sectional perspective view of the communications jack of FIG. 6.
Figure 9:
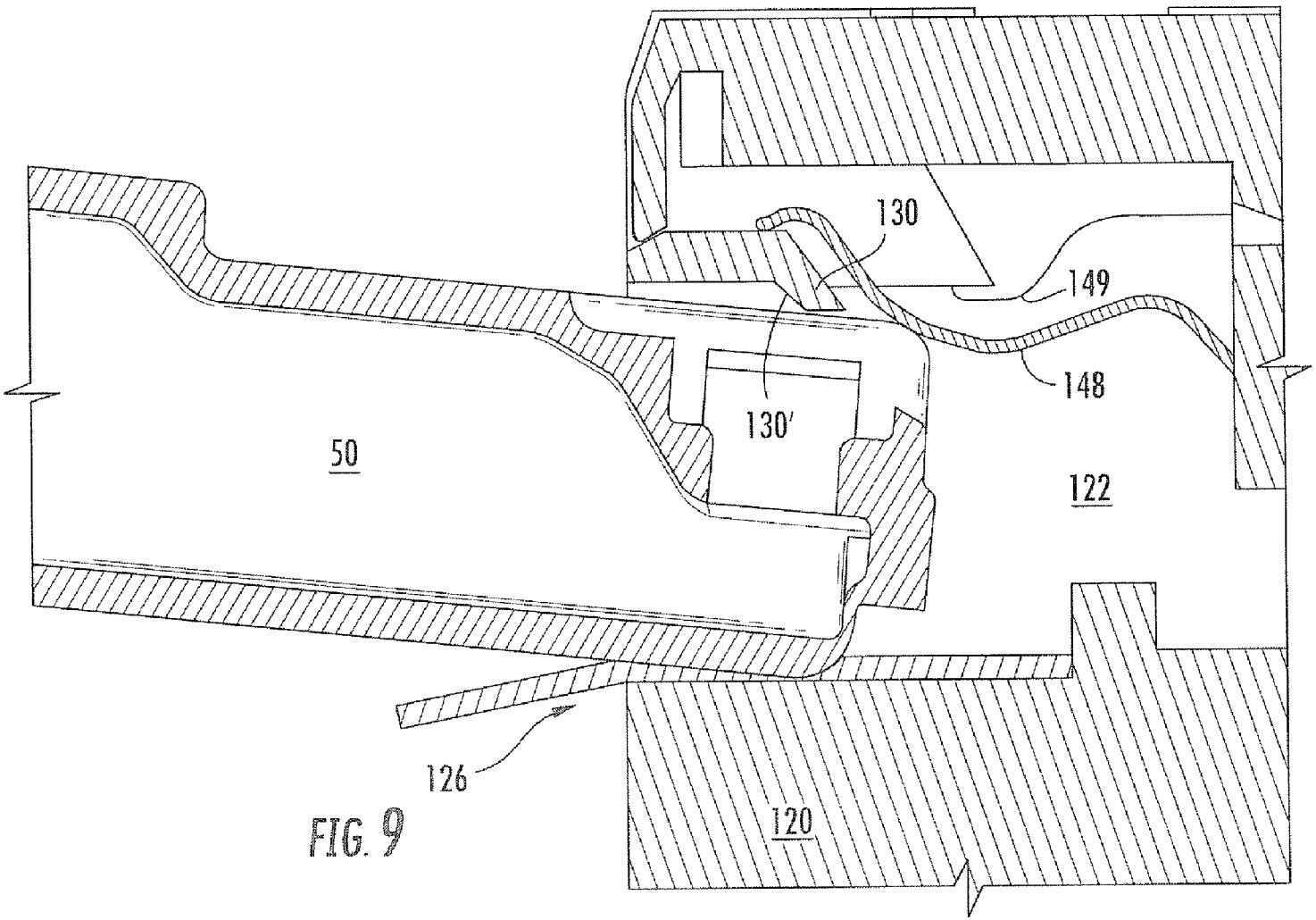
FIG. 9 is a cross-sectional view of the jack frame of the communications jack of FIG. 6 with an RJ-11 communications plug partially inserted therein.
Figure 10:
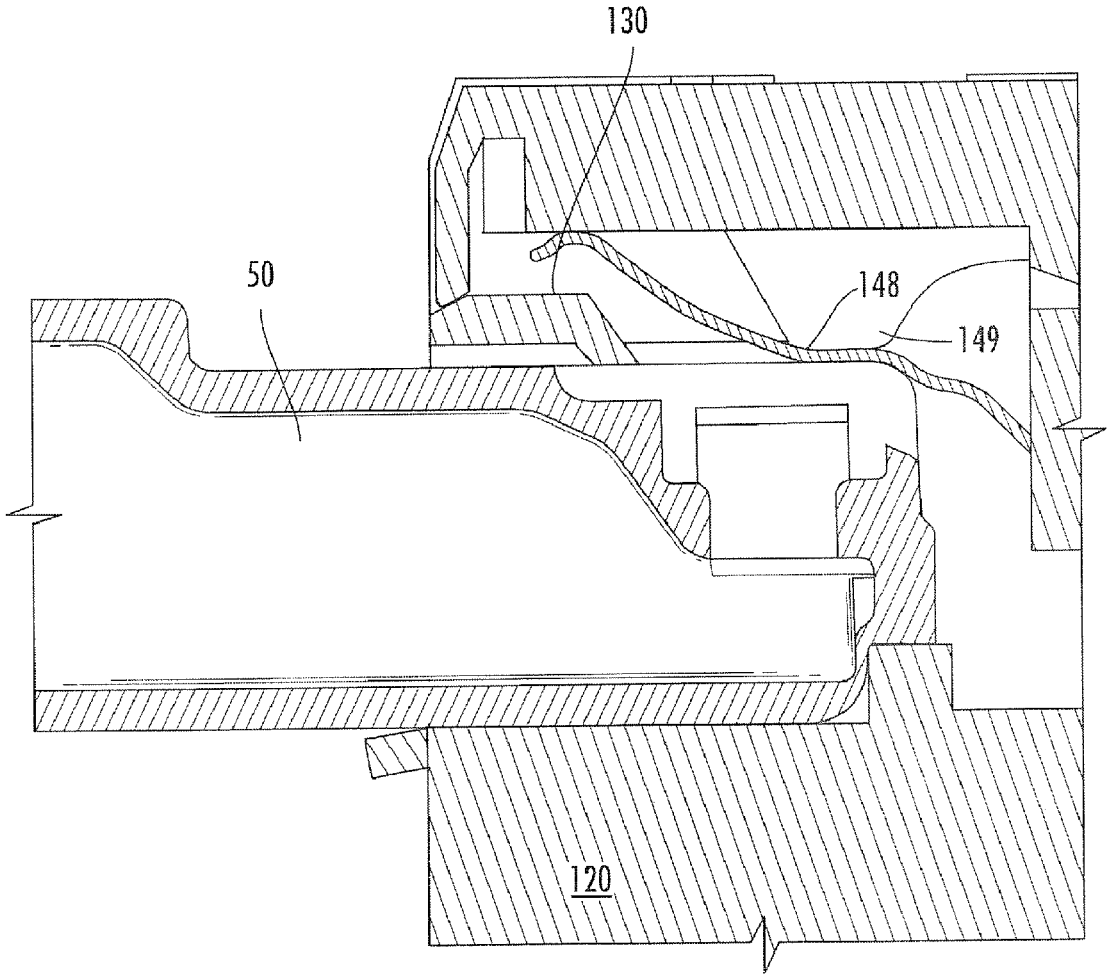
FIG. 10 is a cross-sectional view of the jack frame of the communications jack of FIG. 6 with an RJ-11 communications plug fully inserted therein.
Figure 11:
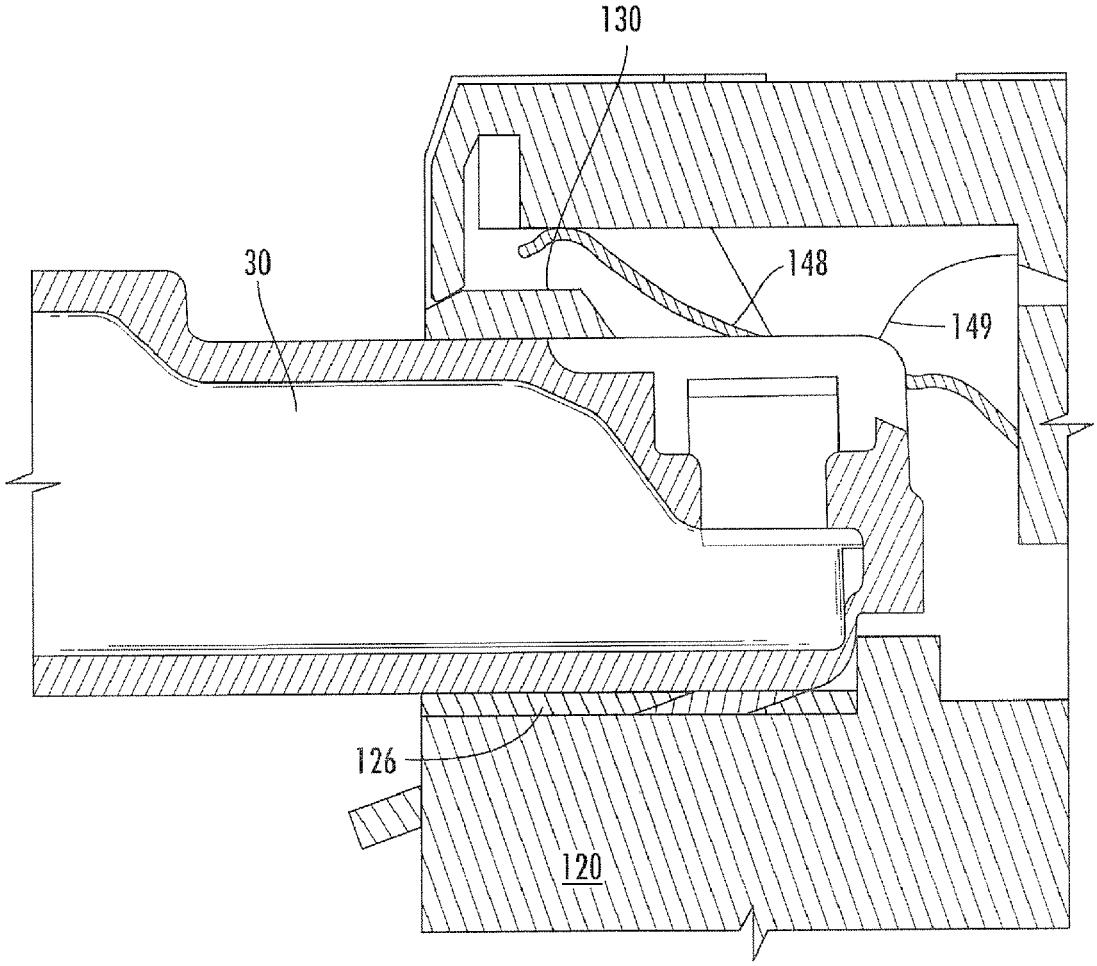
FIG. 11 is a cross-sectional view of the jack frame of the communications jack of FIG. 6 with an RJ-45 communications plug fully inserted therein.

FIG. 7 is an enlarged, partial perspective view of the jack frame 120 of communications jack 100 of FIG. 6. FIG. 8 is a partial, cross-sectional perspective view of the top cover 110 and the jack frame 120 that illustrates the guides that are used to redirect any RJ-11 communications plug that is inserted into the jack frame and the jackwire contact deflection limiters. FIG. 9 is a cross-sectional view of the top cover 110 and the jack frame 120 with an RJ-11 communications plug partially inserted therein. FIG. 10 is a cross-sectional view of the top cover 110 and the jack frame 120 with the RJ-11 communications plug fully inserted therein. FIG. 11 is a cross-sectional view of the top cover 110 and the jack frame 120 with an RJ-45 communications plug fully inserted therein. Certain structures that may facilitate preventing an RJ-11 plug that is inserted into the plug receiving cavity 122 from permanently deforming the contacts 141-148 will now be described with respect to FIGS. 7-11.

As shown in FIG. 7, the plug receiving cavity 122 of jack frame 120 has a stepped bottom surface 123-1, 123-2, 123-3 (which is also generically referred to as bottom surface 123 herein), a top surface 124 and a pair of opposed side surfaces 125. Herein the bottom surface 123 is also referred to as a "lower surface" and/or as a "bottom wall," the top surface 124 is also referred to as an "upper surface" and/or as a "top wall," and the side surfaces 125 are also referred to as "side walls." It will be appreciated that these surfaces/walls need not be complete surfaces or walls, but may be partial walls, may include cutouts and the like and/or may be formed from multiple pieces. It will also be appreciated that these surfaces/walls need not be planar. Instead, these surfaces/walls merely need to define a plug receiving cavity that is configured to receive a mating plug.

The stepped bottom surface 123 of the plug receiving cavity 122 includes three levels 123-1, 123-2, 123-3 that are positioned at three different depths. As shown in FIG. 7, the highest level 123-3 of the stepped bottom surface 123 comprises two separate surfaces 123-3 that are located adjacent the respective opposed side surfaces 125 of the plug receiving cavity 122. The depth of the highest level 123-3 may be selected so that the vertical distance "$d_1$" shown in FIG. 7 is set to be slightly larger than the depth of the housing of a standards-compliant RJ-45 communications plug so that the RJ-45 communications plug will snugly fit within the plug receiving cavity 122. As the width of an RJ-45 communications plug is slightly smaller than the width $d_2$ of the plug receiving cavity 122, when an RJ-45 communications plug is inserted into the plug receiving cavity 122, the left and right edges of the bottom surface of the housing of the RJ-45 communications plug will ride atop the respective surfaces 123-3. As a result, any RJ-45 communications plug that is inserted into the plug receiving cavity 122 will fit snugly within the plug receiving cavity between the side surfaces 125, the top surface 124 and the top level 123-3 of the stepped bottom surface 123.

The middle level 123-2 of the stepped bottom surface 123 comprises two separate surfaces 123-2 that are located between the lowest level 123-1 and the highest levels 123-3. The vertical walls that connect the middle level 123-2 to the top level 123-3 on each side of the plug receiving cavity 122 define the sidewalls of a first channel 126 that is configured to receive any RJ-11 communications plug that is inserted into jack frame 120. The middle level 123-2 of the stepped bottom surface 123 defines the bottom of this first channel 126.

As can be seen in FIG. 7, the center portion of the bottom of the first channel 126 opens up into a second channel 127. This second channel 127 is defined by the vertical walls that connect the lowest level 123-1 to the middle level 123-2 on each side of the plug receiving cavity 122 and by the lowest level 123-1 of the stepped bottom surface 123, which forms the bottom of the second channel 127. The second channel 127 is configured to receive the latch of a mating RJ-11 or RJ-45 style communications plug. When a mating plug is inserted into the plug receiving cavity 122, the latch on the plug enters the plug receiving cavity 122 between the sidewalls of the channel 127. Thus, the channel 127 acts to align the mating plug so that the plug is generally centered between the opposed side surfaces 125 of the plug receiving cavity 122.

A pair of latch catches 128 are provided at the front entrance of the second channel 127. Once a plug is fully inserted into the plug receiving cavity 122, the latch of the plug may be retained by the latch catches 128. An optional abutment 129 extends upwardly from the lowest level 123-1 of the stepped bottom surface 123 into the second channel 127. The abutment 129 interfaces with the latch on a mating plug and may assist in holding the plug tight against the latch catches 128.

As is also shown in FIG. 7, a pair of guides 130, 131 extend into the plug receiving cavity 122 from the top surface 124 of the plug receiving cavity 122. Herein, the term "guide" refers to a structure that directs a mating RJ-11 communications plug in a certain direction when the plug is being inserted into the plug receiving cavity 122. A plurality of walls 133 are provided on a surface 134 that is opposite the top surface 124 of the plug receiving cavity. The walls 133 define a plurality of jackwire contact guide slots 135. Each of the jackwire contact guide slots 135 receives the distal end of a respective one of the jackwire contacts 141-148, thereby allowing the distal end of each jackwire contact 141-148 to deflect upwardly beyond the top surface 124 of the plug receiving cavity 122. The jackwire contact guide slots 135 may facilitate reducing the amount of stress that a mating plug places on certain portions of the jackwire contacts 141-148, thereby reducing the likelihood that a mating plug may act to permanently deform any of the jackwire contacts. As can be seen in FIG. 7, the guides 130, 131 are aligned with respective of the outermost jackwire contact guide slots 135.

As is also shown in FIG. 7, a plurality of alignment bars 132 may also extend into the plug receiving cavity 122 from the top surface 124 of the plug receiving cavity 122. Each of the alignment bars 132 is positioned in transverse alignment with the plug contact region of a respective one of the interior jackwire contacts 142-147 (i.e., each alignment bar and its respective interior jackwire contact has the same coordinate in the transverse dimension). The alignment bars 132 may be shaped identically or similarly to the guides 130, 131. Structures 132 are called "alignment bars" as opposed to guides herein because these structures will not act to force or guide the RJ-11 communications plug downwardly, as each alignment bar 132 will instead simply enter one of the contact slots on a mating plug (be it an RJ-11 communications plug or an RJ-45 communications plug). The alignment bars 132 may, however, help to reduce or prevent a lateral twisting motion that might otherwise occur when an RJ-11 communications plug is inserted into jack frame 120, as each alignment bar 132 will contact the sidewalls of the respective contact slot that it enters on a mating plug, thereby assisting in reducing and/or preventing any such lateral twisting motion. While a total of six alignment bars 132 are illustrated in FIG. 7, it will be appreciated that less than six alignment bars 132 may be provided in other embodiments, and that the alignment bars 132 may be omitted. It will also be appreciated that at least one of the guides 130, 131 may be omitted in some embodiments.

FIG. 8 is a cross-sectional view taken through the center of the jack 100 of FIG. 6 along the longitudinal axis of the jack 100. FIG. 8 better illustrates the positions of the guide 130 and several of the alignment bars 132 on the top surface 124 of the plug receiving cavity 122, and also illustrates the jackwire contact deflection limiters 149 which may further assist in preventing permanent deformation of the jackwire contacts 141-148 when an RJ-11 communications plug is inserted into the plug receiving cavity 122 of communications jack 100.

As is shown in FIG. 8, the guide 130 may comprise a thin member that extends into the plug receiving cavity 122 from the top surface 124 of the plug receiving cavity 122. In some embodiments, the guide 130 may have a curved front surface 130' (i.e., the surface facing the plug aperture 121). As a result of the curved front surface 130', the distal end of guide 130 is farther from the plug aperture 121 than is the base of the guide 130. While the front surface 130' of guide 130 is curved in the particular embodiment depicted in FIGS. 7-11, it will be appreciated that other shapes and configurations may be used in other embodiments such as planar front surfaces, angled front surfaces, etc. The width of guide 130 is less than the width of the contact slots on a mating RJ-11 or RJ-45 plug (i.e., less than the width of the slots 31'-38' on plug 30 of FIG. 2B). For example, the width of the guide 130 may be less than 0.022 inches. Likewise, the depth of guide 130 (i.e., the distance to which the distal end of the guide 130 extends downwardly into the plug receiving cavity 122) is less than the depth of the contact slots on a mating RJ-11 or RJ-45 plug. For example, in some embodiments, the guides 130, 131 (and the alignment bars 132 as well) may extend into the plug receiving cavity to a depth of about 0.011 inches. As shown in FIG. 8, each of the alignment bars 132 may have an identical shape and configuration as the guide 130 (although this need not be the case). Guide 131 (which is not visible in FIG. 8) may be identical to guide 130 except for the location where it is mounted on the jack frame 120.

As is also shown in FIG. 8, the jack 100 includes a plurality of jackwire contact deflection limiters 149 which extend from the top surface 124 toward (and slightly into) the plug receiving cavity 122. In some embodiments, each jackwire contact deflection limiters 149 may extend from about 1 mil to about 8 mils into the plug receiving cavity 122. In other embodiments, the jackwire contact deflection limiters 149 may not extend into the plug receiving cavity, but instead may simply act to limit how far the jackwire contacts can deflect outside of the plug receiving cavity. Herein, the term "jackwire contact deflection limiter" refers to a structure or surface that is designed to limit the extent to which a mating communications plug may deflect a corresponding jackwire contact in a particular direction. In this particular embodiment, a jackwire contact deflection limiter 149 is positioned on the back side of each of the jackwire contacts 141-148, whereas the guides 130, 131 and the alignment bars 132 are positioned on the front side of their respective jackwire contacts 141-148. As shown best in FIGS. 9 and 10, each jackwire contact deflection limiter 149 comprises a surface that protrudes slightly into the plug receiving cavity that is transversely aligned with a portion of a respective one of the jackwire contacts. Herein, the term "transversely aligned" means that the identified items generally have the same coordinate in the transverse dimension as that dimension is defined herein. The jackwire contact deflection limiters 149 may, in some embodiments, be configured to have the same general shape as the portion of their corresponding jackwire contact 141-148 will have when that jackwire contact is being pressed against the jackwire contact deflection limiter 149 by a mating plug.

In the particular embodiment of FIGS. 6-11, the jackwire contact deflection limiters 149 comprise separate protrusions that are positioned above and behind their respective jackwire contacts 141-148. It will be appreciated that other configurations may be used such as, for example, a single bar that extends laterally behind some or all of the jackwire contacts. It will also be appreciated that, in some embodiments, jackwire contact deflection limiters 149 may only be provided with respect to a subset of the jackwire contacts (e.g., for jackwire contacts 141 and 148), or may be omitted completely from the jack.

FIG. 9 is a cross-sectional view that shows the positioning of jackwire contact 148 when an RJ-11 communications plug 50 is partially received within the plug receiving cavity 122 of jack frame 120 (jackwire contacts 141-147 are not depicted in FIGS. 9-11 in order to simplify the drawings). As the RJ-11 communications plug 50 is inserted into the plug receiving cavity 122, the guide 130 (as well as the guide 131, which is not visible in FIG. 9) contacts the leading edge of the plug housing. As the guide 130 contacts the leading edge of the housing of the RJ-11 communications plug 50, the angled front surface 130' of the guide 130 forces the plug 50 downward as the plug is inserted further into the jack frame 120. As shown in FIG. 9, eventually, the leading edge of the housing of the RJ-11 communications plug 50 is inserted past the guide 130, at which point the bottom surface of the guide 130 contacts the top surface of the plug housing.

As is apparent from FIGS. 7 and 9, as the guides 130, 131 force the housing of the RJ-11 communications plug 50 downward, the bottom surface of the plug housing is forced into the channel 126 such that the bottom surface of the plug housing contacts the middle level 123-2 of the stepped bottom surface 123 of the plug receiving cavity 122. Since the RJ-11 communications plug 50 is narrower than an RJ-45 communications plug, and since the latch on the RJ-11 communications plug 50 will keep the RJ-11 communications plug 50 centered laterally when the plug is inserted into the plug receiving cavity 122, the bottom surface of the housing of the RJ-11 communications plug 50 does not extend far enough laterally to come into contact with the two separate surfaces that comprise the highest level 123-3 of the bottom surface 123 of the plug receiving cavity 122 when the RJ-11 communications plug 50 is inserted into the plug receiving cavity 122. As such, the two surfaces 123-3 will not act to prevent the RJ-11 communications plug 50 from being forced into the channel 126 as the plug is inserted into the plug receiving cavity 122.

FIG. 10 is a cross-sectional view of the top cover 110 and the jack frame 120 of the communications jack 100 of FIG. 6 with the RJ-11 communications plug 50 is fully inserted therein. Herein, references to a plug that is "fully inserted" into a jack refer to a plug that has been inserted longitudinally into the plug receiving cavity 122 of the jack 100 sufficiently for the latch of the plug to be captured by the latch catches 128 of the jack 100, which is the distance that an RJ-45 communications plug would be inserted into a mating jack during normal operation. As shown in FIG. 10, the RJ-11 communications plug 50 may be fully inserted into the plug receiving cavity 122. When the RJ-11 communications plug 50 is in this fully inserted position, the guide 130 forces the plug 50 towards the bottom of the plug receiving cavity 122, away from the jackwire contacts 141-148, thereby reducing the amount of force that the plug 50 places on the jackwire contacts 141-148. Thus, the guides 130, 131 may act to reduce the possibility that an RJ-11 communications plug that is inadvertently inserted into the communications jack 100 permanently deforms or otherwise damages any of the jackwire contacts 141-148 and, in particular, the especially vulnerable jackwire contacts 141 and 148.

As is also shown in FIG. 10, the jackwire contact deflection limiters 149 may also facilitate reducing the possibility that any of the jackwire contacts 141-148 are damaged when the RJ-11 communications plug 50 is inserted into the plug receiving cavity 122. As is apparent from FIG. 10, a fully inserted (or partially inserted) RJ-11 communications plug 50 may be free to pivot about the guide 130 (as well as guide 131), which acts as a fulcrum. If the leading edge of the RJ-communications plug 50 pivots upwardly, it can deflect the jackwire contacts 141-148 upwardly even farther than is shown in FIG. 10. In some case, this additional upward deflection may be sufficient to permanently deform one or more of the jackwire contacts 141-148 (or to do so after multiple RJ-11 communications plug insertions). As can be seen from FIG. 10, each jackwire contact deflection limiter 149 acts to limit the degree to which the upper surface of the housing of a fully inserted RJ-11 communications plug can deflect the respective jackwire contacts 141-148 upwardly, as each jackwire contact deflection limiter 149 contacts the side of its respective jackwire contact 141-148 that is opposite the plug, and thereby prevents further upward deflection of the jackwire contact 141-148. As a result of this configuration, an RJ-11 communications plug may be repeatedly inserted into the plug receiving cavity 122 without permanently deforming or damaging the jackwire contacts 141-148.

FIG. 11 is a cross-sectional view of the top cover 110 and the jack frame 120 of communications jack 100 with an RJ-45 communications plug 30 is fully inserted therein. As is apparent from FIGS. 7 and 11, when an RJ-45 communications plug 30 is inserted into the plug receiving cavity 122, the bottom surface of the housing of the plug 30 comes into contact with the two separate surfaces that comprise the highest level 123-3 of the bottom surface 123 of the plug receiving cavity 122. Consequently, the RJ-45 communications plug 30 does not enter the channel 126 as it is inserted because the housing of the RJ-45 plug 30 extends essentially the full width of the plug aperture 121; hence the bottom surface of the plug housing will ride on the two surfaces 123-3 and travel above the channel 126. Moreover, as discussed above, the width and depth of the guides 130, 131 are configured so that the guides 130, 131 will travel within the contact slots on the mating RJ-45 communications plug 30, and hence will not act to urge an RJ-45 communications plug 30 downwardly (as they do with respect to an RJ-11 communications plug). As a result, when the RJ-45 communications plug 30 is inserted into the plug receiving cavity 122, it will enter the plug receiving cavity 122 normally in the same manner that it would enter the plug receiving cavity were the guides 130, 131 and/or the channel 126 omitted from the jack design.

As described above, RJ-45 communications jacks according to embodiments of the present invention may have an RJ-11 communications plug fully inserted therein without permanently deforming or otherwise damaging the jackwire contacts of the jack. As such, when an RJ-11 communications plug is inserted into the RJ-45 communications jacks according to embodiments of the present invention, the four or six blades on the plug will make mechanical and electrical contact with corresponding ones of the jackwire contacts, and hence the jack may allow for normal operation with both RJ-11 and RJ-45 style communications plugs. This is in contrast to many prior solutions for the "RJ-11 plug problem," which solutions focus on preventing an RJ-11 communications plug from being fully inserted within an RJ-45 communications jack. An example of a situation where it may be advantageous to have an RJ-11 communications plug operate properly with an RJ-45 communications jack is a situation where an analog facsimile machine is hooked into a communications network.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An RJ-45 style communications jack comprising:

a housing having a plug receiving cavity, the plug receiving cavity being defined at least in part by opposed upper and lower surfaces;

a first guide protruding from the upper surface into the plug receiving cavity, the first guide having a width that is less than a width of a contact slot on an RJ-45 style communications plug;

a first channel in the lower surface, wherein a width of the first channel is greater than a width of a housing of an RJ-11 style communications plug but less than a width of a housing of an RJ-45 style communications plug, and wherein a length of the first channel is sufficient to allow the RJ-11 style communications plug to be fully inserted within the plug receiving cavity.

2. The RJ-45 style communications jack of claim 1, wherein at least a portion of a surface of the first guide that faces a front opening into the plug receiving cavity is sloped.

3. The RJ-45 style communications jack of claim 1, further comprising a second channel in the lower surface of the housing that runs in the center of the first channel so as to increase the depth of a central portion of the first channel, wherein the second channel is sized to receive a latch portion of the RJ-45 style communications plug.

4. The RJ-45 style communications jack of claim 1, wherein the first guide is transversely aligned with a first blade of the RJ-45 style communications plug when the RJ-45 style communications plug is received within the plug receiving cavity.

5. The RJ-45 style communications jack of claim 4, wherein the first blade comprises a blade that is on one end of a row of blades provided on the RJ-45 style communications plug.

6. The RJ-45 style communications jack of claim 1, further comprising a second guide that protrudes from the upper surface into the plug receiving cavity, the second guide being spaced apart from the first guide.

7. The RJ-45 style communications jack of claim 6, wherein the first guide is positioned to be transversely aligned with a first blade of the RJ-45 style communications plug and the second guide is positioned to be transversely aligned with a second blade of the RJ-45 style communications plug when the RJ-45 style communications plug is received within the plug receiving cavity, wherein the first blade comprises a blade that is on one end of a row of blades provided on the RJ-45 style communications plug and the second blade comprises a blade that is on the other end of the row of blades.

8. An RJ-45 style communications jack comprising:

a housing having a plug receiving cavity;

a first guide that extends into the upper portion of the plug receiving cavity;

wherein a first channel is provided in a lower portion of the plug receiving cavity, wherein a width of the first channel is greater than a width of a plug housing of an RJ-11 style communications plug but less than a width of a housing of an RJ-45 style communications plug, and wherein a length of the first channel is sufficient to allow the RJ-11 style communications plug to be fully inserted within the plug receiving cavity;

wherein the first guide is configured to contact a surface of the plug housing of the RJ-11 style communications plug that includes a plurality of plug contacts when the RJ-11 style communications plug is inserted within the plug receiving cavity to direct the RJ-11 style communications plug downwardly into the first channel and is further configured to allow the housing of the RJ-45 style communications plug to be inserted within the plug receiving cavity without directing the RJ-45 style communications plug downwardly into the first channel.

9. An RJ-45 style communications jack comprising:

a housing having a plug receiving cavity, the plug receiving cavity being defined at least in part by opposed upper and lower surfaces;

a first guide protruding from the upper surface into the plug receiving cavity;

a first channel in the lower surface, wherein a width of the first channel is greater than a width of a housing of an RJ-11 style communications plug but less than a width of a housing of an RJ-45 style communications plug, and wherein a length of the first channel is sufficient to allow the RJ-11 style communications plug to be fully inserted within the plug receiving cavity;

first through eighth jackwire contacts which are mounted to extend into the plug receiving cavity; and a first jackwire contact deflection limiter, wherein a plug contact region of the first jackwire contact, the first guide and the first jackwire contact deflection limiter are transversely aligned with each other, and wherein the first guide and the first jackwire contact deflection limiter are on opposite sides of the first jackwire contact, and wherein the first guide is transversely aligned with a first blade of the RJ-45 style communications plug when the RJ-45 style communications plug is received within the plug receiving cavity.

10. The RJ-45 style communications jack of claim 9, wherein the first jackwire contact deflection limiter is configured to limit the upward deflection of at least part of the first jackwire contact.

11. The RJ-45 style communications jack of claim 9, wherein the upper surface of the plug receiving cavity includes first through eighth guide slots that receive respective ones of the distal ends of the first through eighth jackwire contacts.

12. The RJ-45 style communications jack of claim 9, wherein the upper surface of the plug receiving cavity comprises at least first and second housing pieces, wherein the first guide protrudes from the first housing piece and the first jackwire contact deflection limiter is part of the second housing piece.

13. An RJ-45 style communications jack comprising:

a housing having a plug receiving cavity, the plug receiving cavity being defined at least in part by opposed upper and lower surfaces;

a first guide protruding from the upper surface into the plug receiving cavity;

a first channel in the lower surface, wherein a width of the first channel is greater than a width of a housing of an RJ-11 style communications plug but less than a width of a housing of an RJ-45 style communications plug, and wherein a length of the first channel is sufficient to allow the RJ-11 style communications plug to be fully inserted within the plug receiving cavity;

wherein a surface of the first guide that faces a front opening into the plug receiving cavity is positioned to engage a leading edge of the housing of the standards compliant RJ-11 style communications plug when the RJ-11 style communications plugs is received within the plug receiving cavity, and wherein the first guide is positioned to be aligned with a contact slot on the RJ-45 style communications plug and travel within the contact slot when the RJ-45 style communications plug is received within the plug receiving cavity.

14. The RJ-45 style communications jack of claim 7, further comprising:

first through eighth jackwire contacts which each include a respective plug contact region, where the first through eighth jackwire contacts are mounted so that their respective plug contact regions extend into the plug receiving cavity and are generally aligned in numerical order in a row;

a first jackwire contact deflection limiter; and a second jackwire contact deflection limiter, wherein the plug contact region of the first jackwire contact, the first guide and the first jackwire contact deflection limiter are transversely aligned with each other, wherein the plug contact region of the eighth jackwire contact, the second guide and the second jackwire contact deflection limiter are transversely aligned with each other, wherein the first guide and the first jackwire contact deflection limiter are on opposite sides of the first jackwire contact, and wherein the second guide and the second jackwire contact deflection limiter are on opposite sides of the eighth jackwire contact.

15. A RJ-45 style communications jack, comprising:

a jack frame that has a top wall, a bottom wall and opposed first and second side walls that define a plug receiving cavity;

first through eighth jackwire contacts which each include a plug contact region, where the first through eighth jackwire contacts are mounted so that their respective plug contact regions extend into the plug receiving cavity generally aligned in a row in numerical order;

a first guide extending from an interior surface of the top wall into the plug receiving cavity; and a first jackwire contact deflection limiter extending from the interior surface of the top wall into the plug receiving cavity, wherein the first jackwire contact, the first guide and the first jackwire contact deflection limiter are transversely aligned with each other.

16. The RJ-45 style communications jack of claim 15, further comprising a first channel in the bottom wall, wherein a width of the first channel is greater than a width of a housing of an RJ-11 style communications plug but less than a width of a housing of an RJ-45 style communications plug, and wherein a length of the first channel is sufficient to allow the RJ-11 style communications plug to be fully inserted within the plug receiving cavity.

17. The RJ-45 style communications jack of claim 15, further comprising a second channel in the bottom wall that runs in the middle of the first channel so as to increase the depth of a middle portion of the first channel, wherein the second channel is sized to receive a latch portion of a mating RJ-45 style communications plug.

18. The RJ-45 style communications jack of claim 15, wherein the top wall comprises at least first and second wall pieces, wherein the first guide protrudes from the first wall piece and the first jackwire contact deflection limiter is part of the second wall piece.

19. The RJ-45 style communications jack of claim 15, wherein the jack will transmit signals to and from an RJ-11 communications plug that is inserted therein.

20. The RJ-45 style communications jack of claim 15, further comprising:

a second jackwire contact deflection limiter;

a second guide extending from the interior surface of the top wall into the plug receiving cavity, wherein the eighth jackwire contact, the second guide and the second jackwire contact deflection limiter are transversely aligned with each other.

21. The RJ-45 style communications jack of claim 20, wherein the first and second guides each have a width that is less than the width of a contact slot on an RJ-45 style communications plug, and wherein the first and second guides are positioned to be transversely aligned with a respective one of the outside contact slots of the RJ-45 style communications plug when the RJ-45 style communications plug is received within the plug receiving cavity.

22. The RJ-45 style communications jack of claim 20, wherein the first guide and the first jackwire contact deflection limiter are on opposite sides of the first jackwire contact, and wherein the second guide and the second jackwire contact deflection limiter are on opposite sides of the eighth jackwire contact.

23. An RJ-45 style communications jack, comprising:

a housing having a plug receiving cavity, the plug receiving cavity being defined at least in part by opposed upper and lower surfaces;

a plurality of jackwire contacts that are mounted to extend into the plug receiving cavity;

a first jackwire contact deflection limiter that extends into an upper region of the plug receiving cavity and that is configured to limit the degree to which at least a part of a first of the plurality of jackwire contacts can deflect;

a second jackwire contact deflection limiter that extends into an upper region of the plug receiving cavity and that is configured to limit the degree to which at least a part of the second of the plurality of jackwire contacts can deflect; and a first channel in the lower surface, wherein a width of the first channel is greater than a width of a housing of an RJ-11 style communications plug but less than a width of a housing of an RJ-45 style communications plug, and wherein a length of the first channel is sufficient to allow the RJ-11 style communications plug to be fully inserted within the plug receiving cavity.

24. The RJ-45 style communications jack of claim 23, wherein a plug contact region of the first of the plurality of jackwire contacts and the first jackwire contact deflection limiter are transversely aligned with each other, and wherein the first jackwire contact deflection limiter is on an opposite side of the first of the plurality of jackwire contacts from the RJ-11 style communications plugs when the RJ-11 style communications plug is received within the plug receiving cavity.

25. The RJ-45 style communications jack of claim 23, further comprising a second channel in the lower surface that runs in the center of the first channel so as to increase the depth of a central portion of the first channel, wherein the second channel is sized to receive a latch portion of a mating RJ-45 style communications plug.

26. The RJ-45 style communications jack of claim 23, wherein the first and second jackwire contact deflection limiters extend from the upper surface of the housing into the plug receiving cavity.

27. The RJ-45 style communications jack of claim 23, wherein the plurality of jackwire contacts comprises first through eighth jackwire contacts, and further comprising third through eighth jackwire contact deflection limiters that are transversely aligned with respective ones of the third through eighth jackwire contacts.

28. The RJ-45 style communications jack of claim 23, wherein a single structure that extends behind both the first and second of the plurality of jackwire contacts is used to form both the first and second jackwire contact deflection limiters.

29. The RJ-45 style communications jack of claim 23, wherein the plurality of jackwire contacts comprises first through eighth jackwire contacts, wherein the upper surface of the housing includes first through eighth contact slots, and wherein a distal end of each of the first through eighth jackwire contacts extends through a respective one of the first through eighth contact slots.

30. The RJ-45 style communications jack of claim 29, wherein the first through eighth jackwire contacts each include a respective plug contact region, wherein the plug contact regions of the first through eighth contacts are generally aligned in a row, and wherein the plug contact regions of the first and second of the plurality of jackwire contacts are on the outside ends of the row.

31. An RJ-45 style communications jack comprising:

a housing having an upper surface and a lower surface that is opposite the upper surface, the upper and lower surfaces at least in part defining a plug receiving cavity;

a first channel in the lower surface, wherein a width of the first channel is greater than a width of a housing of an RJ-11 style communications plug but less than a width of a housing of an RJ-45 style communications plug, and wherein a length of the first channel is sufficient to allow the RJ-11 style communications plug to be fully inserted within the plug receiving cavity; and a second channel in the lower surface of the housing that runs in a central portion of the first channel so as to increase the depth of the central portion of the first channel, wherein the second channel is sized to receive a latch portion of the RJ-45 style communications plug, wherein a first longitudinal axis that bisects the first channel is vertically aligned with a second longitudinal axis that bisects the second channel.

32. The RJ-45 style communications jack of claim 31, further comprising a guide protruding from the upper surface into the plug receiving cavity, wherein the guide is positioned to travel within a contact slot of an RJ-45 style communications plug when the RJ-45 style communications plug is inserted within the plug receiving cavity.

* * * * *